US010184464B2

(12) United States Patent
Bagagli et al.

(10) Patent No.: US 10,184,464 B2
(45) Date of Patent: Jan. 22, 2019

(54) ELECTROMAGNETIC ACTUATOR AND INERTIA CONSERVATION DEVICE FOR A RECIPROCATING COMPRESSOR

(71) Applicant: Nuovo Pignone Srl, Florence (IT)

(72) Inventors: Riccardo Bagagli, Florence (IT); Leonardo Tognarelli, Florence (IT); Massimo Bargiacchi, Florence (IT); Alessio Capanni, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 275 days.

(21) Appl. No.: 14/401,320

(22) PCT Filed: May 10, 2013

(86) PCT No.: PCT/EP2013/059710
§ 371 (c)(1),
(2) Date: Nov. 14, 2014

(87) PCT Pub. No.: WO2013/171126
PCT Pub. Date: Nov. 21, 2013

(65) Prior Publication Data

US 2015/0139819 A1 May 21, 2015

(30) Foreign Application Priority Data

May 16, 2012 (IT) ..... CO2012A0027

(51) Int. Cl.
*F04B 35/04* (2006.01)
*F04B 35/01* (2006.01)

(52) U.S. Cl.
CPC ..... *F04B 35/04* (2013.01); *F04B 35/01* (2013.01); *F04B 35/045* (2013.01)

(58) Field of Classification Search
CPC ... F04B 11/00; F04B 11/0008; F04B 11/0033; F04B 17/03; F04B 17/04; F04B 35/04;
(Continued)

(56) References Cited

U.S. PATENT DOCUMENTS 1,978,866 A 10/1934 Konig
4,334,833 A 6/1982 Gozzi
(Continued)

FOREIGN PATENT DOCUMENTS

CN 1319173 A 10/2001
CN 1766332 A 5/2006
(Continued)

OTHER PUBLICATIONS

Italian Search Report and Written Opinion issued in connection with corresponding IT Application No. CO2012A000027 dated Jan. 8, 2013.
(Continued)

*Primary Examiner* — Kenneth J Hansen
*Assistant Examiner* — Chirag Jariwala
(74) *Attorney, Agent, or Firm* — GE Global Patent Operation; Marc A. Vivenzio

(57) ABSTRACT

A compressor includes a piston disposed in a housing and configured to be reciprocatably driven in the housing by an electromagnetic drive. A conventional linear motor drive assembly reciprocatably drives the piston in an embodiment. A magnetically-geared drive assembly reciprocatably drives the piston in another embodiment. A solenoid drive assembly reciprocatably drives the piston in another embodiment. A control system is coupled to the drive for varying piston displacement, and an accumulator conserves force by decelerating a translating assembly at the end of one stroke and accelerating the assembly in a subsequent stroke.

16 Claims, 10 Drawing Sheets

(58) Field of Classification Search
CPC ..... F04B 35/045; F15B 2201/21; F15B 1/02; F15B 1/04; F15B 15/1447; F15B 15/226; F15B 15/228
See application file for complete search history.

(56) References Cited

U.S. PATENT DOCUMENTS

| | | | | |
|---|---|---|---|---|
| 4,832,578 | A | 5/1989 | Putt | |
| 5,273,409 | A | 12/1993 | Swain | |
| 5,354,185 | A | 10/1994 | Morinego et al. | |
| 5,636,601 | A | 6/1997 | Moriya et al. | |
| 6,079,960 | A | 6/2000 | Funatsu et al. | |
| 6,638,035 | B1 | 10/2003 | Puff | |
| 6,733,245 | B2 * | 5/2004 | Oh | F04B 35/045 417/211 |
| 6,746,211 | B2 | 6/2004 | Kwon et al. | |
| 6,753,665 | B2 | 6/2004 | Ueda et al. | |
| 6,793,470 | B2 | 9/2004 | Song et al. | |
| 7,213,683 | B2 | 5/2007 | Lilie et al. | |
| 7,316,547 | B2 | 1/2008 | Lilie | |
| 7,459,868 | B2 | 12/2008 | Yoo et al. | |
| 7,516,940 | B2 | 4/2009 | Kopecek et al. | |
| 7,651,069 | B2 | 1/2010 | Kopecek et al. | |
| 9,004,883 | B2 * | 4/2015 | Neelakantan | F04B 17/046 417/410.1 |
| 2002/0155012 | A1 | 10/2002 | Zabar | |
| 2003/0072658 | A1 | 4/2003 | Park et al. | |
| 2003/0077192 | A1 | 4/2003 | Shin | |
| 2003/0218854 | A1 | 11/2003 | Kopecek et al. | |
| 2004/0211628 | A1 | 10/2004 | Kojima et al. | |
| 2004/0265155 | A1 | 12/2004 | Hunter et al. | |
| 2006/0127250 | A1 * | 6/2006 | Park | F04B 35/045 417/417 |
| 2007/0095073 | A1 | 5/2007 | Tian et al. | |
| 2009/0047154 | A1 | 2/2009 | Choi et al. | |
| 2009/0191073 | A1 | 7/2009 | Kopecek et al. | |
| 2009/0250644 | A1 | 10/2009 | Kopecek et al. | |
| 2009/0304525 | A1 * | 12/2009 | Reinschke | F04B 35/045 417/53 |
| 2010/0162733 | A1 | 7/2010 | Hannig et al. | |
| 2011/0058968 | A1 | 3/2011 | Kang et al. | |
| 2011/0318193 | A1 | 12/2011 | Hu et al. | |
| 2012/0034119 | A1 * | 2/2012 | Du | F04B 3/00 417/523 |

FOREIGN PATENT DOCUMENTS

| | | | |
|---|---|---|---|
| FR | 2129746 | A5 | 10/1972 |
| GB | 837312 | A | 6/1960 |
| GB | 1323859 | | 7/1973 |
| GB | 2125223 | A | 2/1984 |
| JP | 5613558 | U | 2/1981 |
| JP | 57186668 | U | 11/1982 |
| JP | 59133784 | U | 9/1984 |
| JP | 06174321 | A | 6/1994 |
| JP | 07280372 | A | 10/1995 |
| JP | 11324912 | A | 11/1999 |
| JP | 2000130325 | A | 5/2000 |
| JP | 2001333569 | A | 11/2001 |
| JP | 2002195674 | A | 7/2002 |
| JP | 2003148339 | A | 5/2003 |
| JP | 2004003408 | A | 1/2004 |
| JP | 2004124896 | A | 4/2004 |
| JP | 2004140902 | A | 5/2004 |
| JP | 2004324792 | A | 11/2004 |
| JP | 20040353563 | A | 12/2004 |
| JP | 2006070734 | A | 3/2006 |
| JP | 2006207472 | A | 8/2006 |
| JP | 2006300066 | A | 11/2006 |
| JP | 2012246982 | A | 12/2012 |
| RU | 2451209 | C2 | 5/2012 |
| SU | 1608360 | A1 | 11/1990 |
| SU | 1682627 | A1 | 10/1991 |
| WO | 9631937 | A1 | 10/1996 |
| WO | 0017585 | A1 | 3/2000 |

OTHER PUBLICATIONS

PCT Search Report and Written Opinion issued in connection with corresponding PCT Application No. PCT/EP131059710 dated Jun. 9, 2015.
Unofficial English translation of Chinese Office Action issued in connection with related CN Application No. 201380025391.6 dated Feb. 1, 2016.
U.S. Appl. No. 14/400,654, filed Nov. 12, 2014, Riccardo Bagagli.
Deffenbaugh et al., "Advanced Reciprocating Compression Technology (ARCT)", Southwest Research Institute, pp. 97-107, Dec. 2005.
Italian Search Report issued in connection with corresponding Italian application CO2012A000028 dated Feb. 4, 2013.
International Search Report issued in connection with corresponding Italian application CO2012A000028 dated Feb. 4, 2013.
Italian Search Report issued in connection with corresponding Italian application CO2012A000027 dated Feb. 4, 2013.
International Search Report issued in connection with corresponding Italian application CO2012A000027 dated Feb. 4, 2013.
Deffenbaugh et. al.: "Advanced Reciprocating Compression Technology (ARCT)", Southwest Research Institute, Dec. 2005, pp. 97-107.
Italian Search Report and Written Opinion dated Jan. 8, 2013 which was issued in connection with Italian Patent Application No. CO20124000027 which was flied on May 16, 2012.
Russian Search Report issued in connection with corresponding RU Application No. 2014144649 dated Dec. 15, 2016.
Unofficial English Translation of Japanese Search Report issued in connection with related JP Application No. 2015512001 dated Feb. 7, 2017.
Unofficial English Translation of Japanese Search Report issued in connection with corresponding JP Application No. 2015512002 dated Feb. 8, 2017.
Unofficial English Translation of Japanese Office Action issued in connection with related JP Application No. 2015512001 dated Feb. 14, 2017.
Unofficial English Translation of Japanese Office Action issued in connection with corresponding JP Application No. 2015512002 dated Feb. 14, 2017.
Unofficial English Translation of Chinese Notice of Allowance issued in connection with related CN Application No. 201380025391.6 dated Mar. 30, 2017.
Russian Office Action issued in connection with corresponding RU Application No. 2014144231 dated Dec. 27, 2016.
U.S. Non-Final Office Action issued in connection with related U.S. Appl. No. 14/400,654 dated Dec. 14, 2016.

* cited by examiner

ELECTROMAGNETIC ACTUATOR AND INERTIA CONSERVATION DEVICE FOR A RECIPROCATING COMPRESSOR

BACKGROUND OF THE INVENTION

The subject matter disclosed herein relates to gas compressors. More particularly, the subject matter disclosed herein relates to reciprocating gas compressors having an inertia conservation feature.

Gas compressors may be broadly grouped as either dynamic or positive displacement gas compressors. Positive displacement type compressors increase gas pressure by reducing volume occupied by the gas. Positive displacement gas compressors operate by confining a fixed amount of gas in a compression chamber, mechanically reducing the volume occupied by the gas thereby compressing the gas, and passing the compressed the gas into a distribution network. The gas pressure increase corresponds to the volume reduction of the space occupied by the amount of gas. As used herein, the term gas includes substances in a gaseous state, substances in a liquid state, and mixtures comprised of substances having both a liquid and a gaseous state.

Positive displacement compressors mechanically reduce the volume occupied gas using either a reciprocating piston or rotating component. Reciprocating compressors successively compress volumes of gas by repetitively driving a compression piston into a compression chamber in a first direction, withdrawing the piston from the compression chamber in a second direction, and allowing a volume of gas to be compressed to occupy the chamber. Each time the piston moves into the compression chamber it sweeps a portion of the chamber, thereby reducing the volume of chamber occupied by the gas, and raising the pressure therein. The compressed gas then exits the chamber, the piston withdraws from the chamber, and a second charge of gas enters the chamber for a subsequent reciprocation of the piston.

Reciprocating compressors may be either single-acting or double-acting. Single-acting compressors, as described above, effect compression only when driving the piston in the first direction. Double-acting compressors include a compression chambers associated with both the front face and rear face of the compression piston, thereby effecting compression with piston movement in both the first and second direction.

Reciprocating compressors may also be either single-stage or multi-stage. In single stage compressors, the compressor compresses the volume of gas in a single mechanical operation—such as in the first piston movement described above. In multi-stage compressors, the compressor compresses the volume of gas in more than one mechanical operation—such as by compressing gas with the front face of the piston in the first movement described above, moving the compressed gas to the chamber associated with the rear face of the piston, and further compressing the gas with the rear face of the piston in the second movement described above. Still other multi-stage compressors include a plurality of compression pistons arranged to compress gas with a plurality of compression operations.

Reciprocating compressors that use pistons for compressing have several disadvantages. For example, the inertial forces associated with the reciprocating components are high in piston-equipped compressors. During successive reciprocations, the compressor drive accelerates the piston in one direction, stops it, and then accelerates it in the opposite direction. The more massive the piston assembly, the greater the force the drive need supply to accelerate and decelerate the assembly. And since the kinetic energy of the assembly is typically dissipated (and not conserved) at the end of the stroke, the compressor is inherently less efficient. Such energy loss can be particularly severe in compressors having comparatively short strokes, where the inertial loads associated with accelerating the piston assembly is the peak load imposed upon the drive assembly. As a result, the majority of the force produced by the compressor drive goes not into compressing gas, but rather into successively accelerating the piston assembly.

In high-pressure natural gas applications, compressors are typically rotary driven. Rotary drives, in turn, have a mechanical connection between the rotating drive and the piston that converts drive shaft rotation into piston linear translation—typically through use of a connecting rod. Connecting rods constrain compression operation such that the portion of the compression chamber swept by the piston is constant. Hence, for purposes of varying the volume of gas compressed without altering drive shaft speed, piston-equipped compressors include a turndown. The turndown alters compression chamber volume by the volume of the chamber within which the piston reciprocates—thereby altering the compression the gas within the chamber undergoes during each stroke. Turndowns present their own disadvantages, such as being time consuming to adjust and even requiring that the compressor be taken off line so that an operator may physically operate a crank to alter the compression chamber volume.

One alternative that provides an adjustable capacity compressor is a linear motor driven compressor. Such a compressor was proposed in the Advanced Reciprocating Compression Technology Final Report, SwRI Project No. 18.11052 prepared under DOE Award No. DE-FC26-04NT42269, Deffenbaugh et al. (the "ARCT Report"), dated December 2005. However, as concluded in the ARCT Report, while a linear motor could be used to drive a reciprocating compressor, current linear motor technology limits such compressors to smaller diameter cylinders, operating at slower speeds and with relatively long stroke lengths—therefore having lower capacity and being unsuitable for conventional natural gas distribution systems. These limitations are due in part to the limited amount of force achievable through existing linear motor technology and in part due to the above-described rod load inertial load requirements.

Accordingly, there is a need for a reciprocating compressor where drive force requirement is driven by the force required to compress the gas in the compression chamber rather than the inertial force required to accelerate the compression piston. There is also a need a reciprocating compressor having a large bore diameter with an associated drive force requirement within the capabilities of existing linear motor technology. Finally, there is a need for a reciprocating compressor having a short stroke length with an associated drive force requirement within the capabilities of existing linear motor technology.

BRIEF DESCRIPTION OF THE INVENTION

Various other features, objects, and advantages of the invention will be made apparent to those skilled in the art from the accompanying drawings and detailed description thereof.

According to an embodiment of the present invention, a reciprocating compressor is provided. The reciprocating compressor comprises a piston reciprocatably disposed in compression cylinder; a translatable assembly connected to the piston; an electromagnetic drive having a fixed stator and a core coupled to the translatable assembly, wherein the drive is configured to reciprocatably drive the translatable assembly within the compression chamber; and an accumulator coupled to the translatable assembly, wherein the accumulator is configured to store kinetic energy resident in the motion of a movement of the translatable assembly in a first direction, and wherein the accumulator is configured to impart kinetic energy resident in the motion of a movement of the translatable assembly in a second direction.

According to an embodiment of the present invention, a method of use for reciprocating comprising a translatable assembly, an accumulator coupled to the translatable assembly, and an electromagnetic drive coupled to the translatable assembly, is provided. The method comprises accelerating the translatable assembly in a first movement direction by applying a force to the translatable assembly with the electromagnetic drive; decelerating the translatable assembly in the first movement direction by storing kinetic energy resident in the translatable assembly in the accumulator; and accelerating the translatable assembly in a second movement direction by generating force from the accumulator stored energy.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following detailed description makes reference to the accompanying drawings that form a part the application and which illustrate certain embodiments of the invention. These embodiments are described in sufficient detail to enable those skilled in the art to practice the embodiments, and it is to be understood that other embodiments may be utilized and that logical, mechanical, electrical and other changes may be made without departing from the scope of the invention. The following detailed description is, therefore, not to be taken as limiting the scope of the invention.

Figure 1:
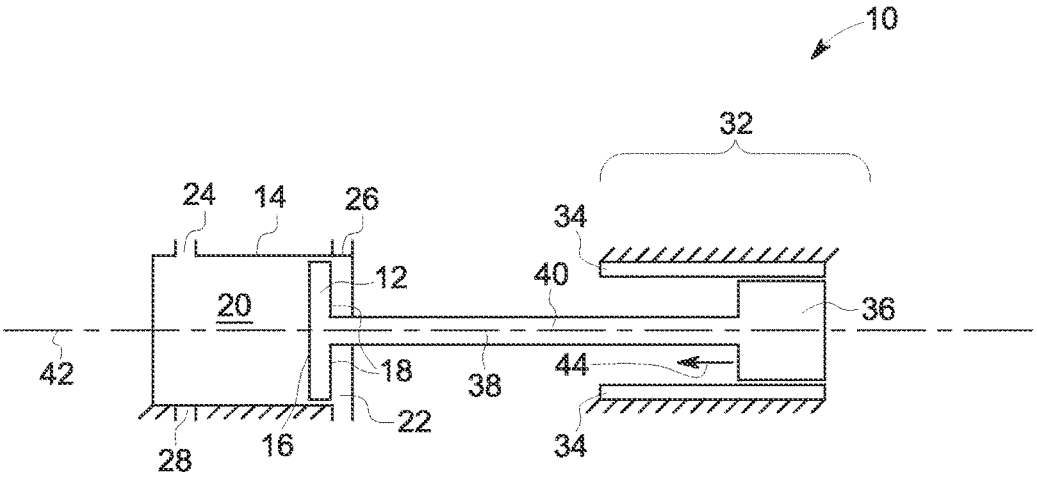
FIG. 1 (PRIOR ART)
FIG. 1 shows a reciprocating compressor of the prior art configured to be electromagnetically actuated by a linear motor, the compressor being arranged in a bottom dead center position.
Figure 2:
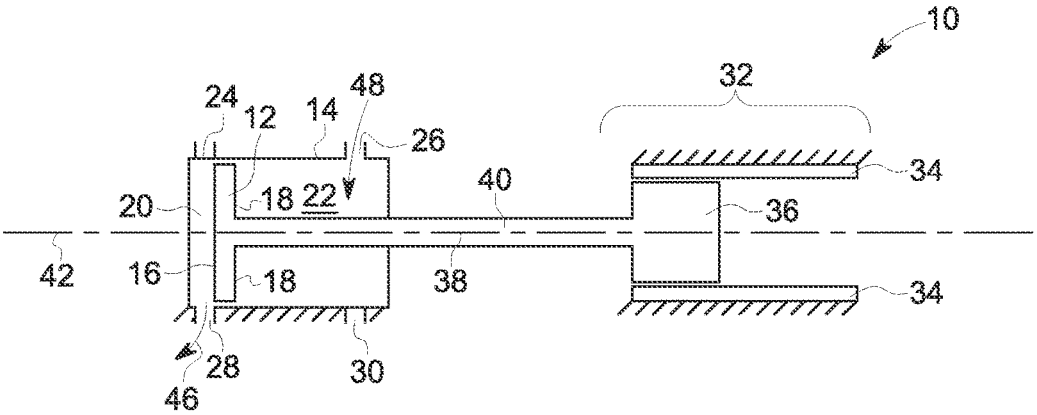
FIG. 2 (PRIOR ART)
FIG. 2 shows the compressor of FIG. 1, the compressor further being arranged in a top dead center position.

FIG. 1 and FIG. 2 show a reciprocating compressor 10. The compressor 10 includes a piston 12 slidably disposed in a cylinder (housing) 14. The piston has a head-end oriented first face 16 and a crank-end oriented second face 18. As used herein, "head-end" refers to the end of the compression assembly furthest from the drive assembly. As also used herein, "crank-end" refers to the end of the compression assembly closest to the drive assembly. Together, piston 12 and cylinder 14 cooperatively define a first and second variable volume compression chamber (20,22), each chamber (20,22) being selectively pneumatically communicative with a gas supply (not shown) through a plurality of inlets (24,26). Each chamber (20,22) is selectively pneumatically communicative with a gas distribution/transmission system (not shown) through a plurality of outlets (28,30). The compressor 10 also includes an electromagnetic drive 32, the drive 32 having a stator 34 and a core 36. A connecting rod 38 attaches the drive core 36 to the piston 12. Collectively, the piston 12, connecting rod 38, and core 36 comprise a translatable assembly 40 configured to be reciprocatably driven along a translation axis 42.

As will be the convention throughout the drawings herein, elements/assemblies having 45 degree hash marks are fixed with respect to elements/assemblies not having such identification. Accordingly, as shown in FIG. 1 and FIG. 2, the stator 34 and cylinder (housing) 14 are fixed with respect to the translatable assembly 40. Upon actuation, the stator 34 and core 36 cooperate such that an axial force is applied to the translatable assembly 40, thereby causing the assembly 40 to translate along axis 42. The drive 32 is configured such that the axial force is reversible, thereby reciprocating the translatable assembly 40 back and forth along axis 42.

As used herein, the term "bottom dead center" refers to a positional arrangement wherein the piston is positioned within the compression assembly on an end adjacent the drive assembly. As used herein, the term "top dead center" refers to a positional arrangement wherein the piston is positioned within the compression assembly on an end opposite the drive assembly. As used herein, the term "reciprocation" refers to successive, alternating movements of the translatable assembly that drive a piston towards the head-end and then toward the crank-end along a translation axis.

FIG. 1 shows the piston 12 positioned at bottom dead center. FIG. 2 shows the piston 12 positioned at top dead center. To move the piston 12 from the bottom dead center position shown in FIG. 1 to the top dead center position shown in FIG. 2, the drive 32 applies a head-end directed force 44 to assembly 40. The force 44 drives the assembly 40 along axis 42, thereby moving the piston 12 toward the head-end of the compression assembly, from the position shown in FIG. 1 to the position shown in FIG. 2

During translation of piston 12 from bottom dead center to top dead center, first piston face 16 applies force to a gas occupying chamber 20, thereby pressurizing the gas. At the same time, the translation of piston 12 also increases the volume of chamber 22. As shown in FIG. 2 by flow arrow 46, the gas compressed by piston 12 flows out of chamber 20 and into the gas distribution/transmission system (not shown). Similarly, as shown in FIG. 2 by a flow arrow 48, a gas to be compressed flows into the chamber 22 the gas supply (not shown). The piston then decelerates, stops at top dead center, reverses direction, and accelerates in the crank-end direction, translating axially along axis 42 toward drive 12, whereby a similar sequence of events occurs.

Figure 3:
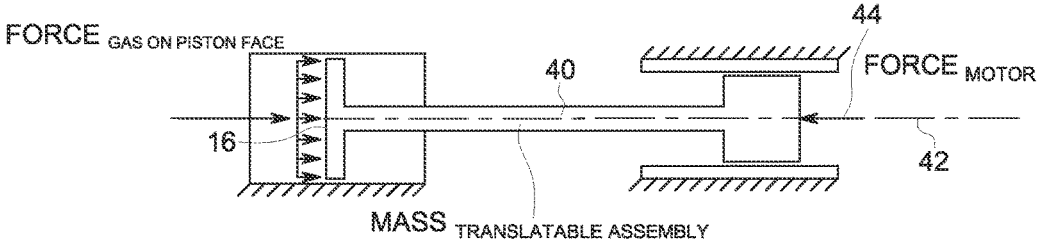
FIG. 3 (PRIOR ART)
FIG. 3 shows the compressor of FIG. 1 and the forces influencing the translatable assembly while moving from bottom dead center to top dead center.
Figure 4:
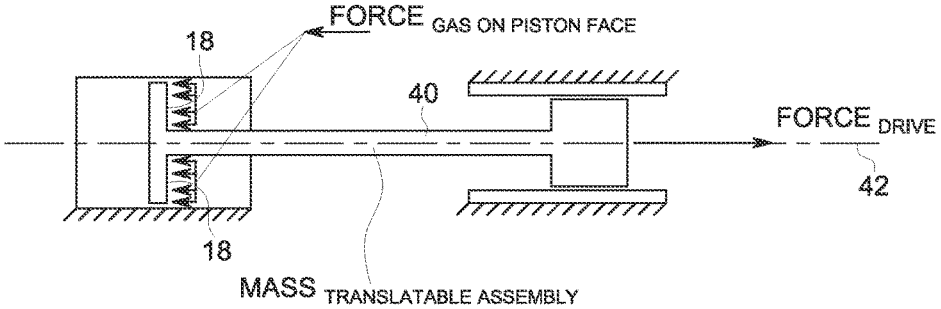
FIG. 4 (PRIOR ART)
FIG. 4 shows the compressor of FIG. 1 and the forces influencing the translatable assembly while moving from top dead center to bottom dead center.

FIG. 3 and FIG. 4 show the forces acting on the translatable assembly 40 during reciprocated translation. FIG. 3 illustrates the forces arranged during the above-discussed translation of assembly 40 along axis 42. The drive 32 applies the discussed head-end oriented drive force 44, labeled in FIG. 3 as "$F_{Drive}$" and having sufficient magnitude to overcome a force exerted on the first piston face 16, labeled as "$F_{Piston\ Face}$". The drive force 44 is also of magnitude sufficient to accelerate the mass of the translatable assembly 40, the mass being labeled as "$M_{Translatable\ Assembly}$" in FIG. 3. In similar manner, FIG. 4 illustrates the forces acting on the translatable assembly 40 during a translation of the assembly 40 along axis 42 whereby the piston is driven toward the crank-end of the compression assembly. In FIG. 4, "$F_{Drive}$" has sufficient magnitude to overcome a force exerted on the second piston face 18, labeled as "$F_{Piston\ Face}$". The drive force 44 is also of magnitude sufficient to accelerate the mass of the translatable assembly 40, the mass being labeled as "$M_{Translatable\ Assembly}$" in FIG. 4. In each FIG. 3 and FIG. 4, the force produced by drive 32 must satisfy the equation:

$$F_{Drive}=(M_{Translatable\ Assembly})*\alpha+F_{Piston\ Face} \quad \text{(Equation 1)}$$

where $\alpha$ is an acceleration of the translatable assembly 40. The term "$(M_{Translatable\ Assembly})*\alpha$" represents the inertial force that must be overcome to accelerate the reciprocating mass of the translatable assembly 40 when undergoing acceleration.

Figure 5:
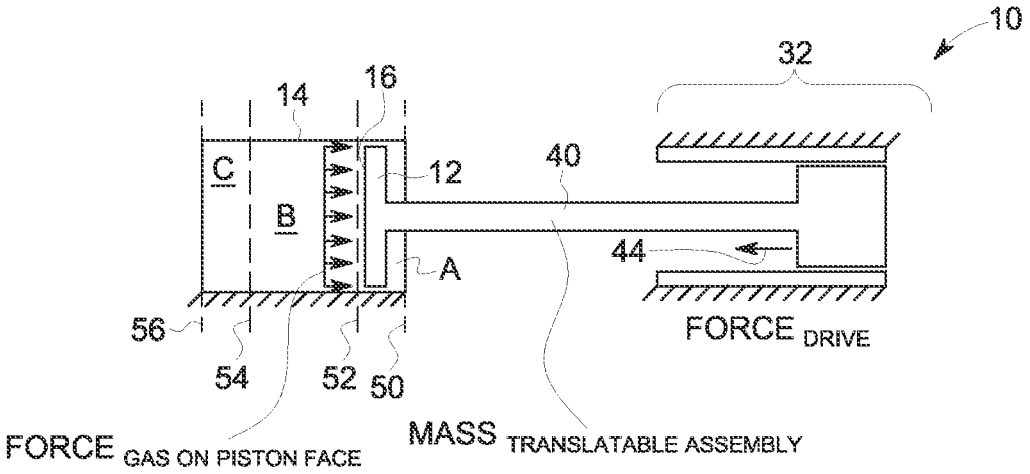
FIG. 5 (PRIOR ART)
FIG. 5 shows the compressor of FIG. 1, wherein the compression chamber is illustratively divided into three regions, each region being associated with a different translatable assembly acceleration.
Figure 6:
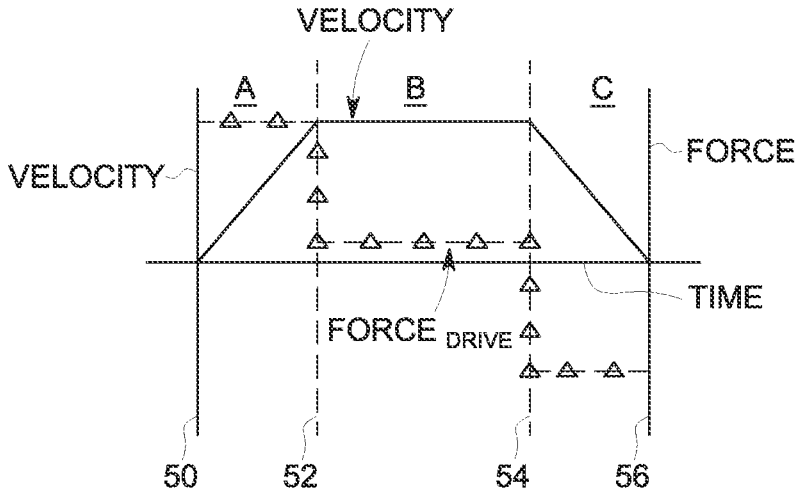
FIG. 6 (PRIOR ART)
FIG. 6 shows a chart comparatively illustrating the relationship between velocity and force versus time when the compressor shown in FIGS. 1-5 moves from top dead center to bottom dead center.

FIG. 5 illustrates an exemplary piston translation by segmenting the cylinder into segments, each cylinder segment having different piston accelerations. FIG. 6 graphically illustrates piston acceleration versus time in the cylinder segments shown in FIG. 5, and further includes a graphical illustration of the relative magnitude of drive force versus time required in each cylinder segment on a common time-axis.

FIG. 5 shows compressor cylinder 14 divided into three sections (A, B, C) by four cylinder sectioning lines (50,52, 54,56). Sectioning lines 50 and 52 define chamber section A, sectioning lines 54 and 56 define chamber section C, and sectioning lines 52 and 54 define chamber section B. As shown in FIG. 6 and with respect to Equation 1, when the piston 12 is at bottom dead center in cylinder section A, drive 32 applies head-end oriented force sufficient to overcome both (a) the gas force applied on the piston first face 16, and (b) increase the inertial force resident in the translatable assembly 40, thereby accelerating the translatable assembly 40. When the piston 12 enters section B, the force requirement drops, drive 32 supplying force sufficient only to overcome (a) the gas force applied on the piston first face 16. Inertia of the translatable assembly 40 is constant in cylinder section B. When piston 12 enters section C, drive 32 once again supplies an increased amount of force, sufficient to overcome both (a) the gas force applied on the piston first face 16, and (b) remove inertial force resident in the translatable assembly 40, thereby decelerating the translation of the assembly 40, causing the assembly to stop and leaving the piston in its top dead center position.

FIG. 6 graphically illustrates the velocity and force changes of the above discussion. FIG. 6 shows velocity and force graphed against time, time appearing on the x-axis, velocity appearing on the left y-axis, and force appearing on the right y-axis. Four graph sectioning lines (50,52,54,56) corresponding to cylinder sectioning lines (50,52,54,56) divide the graph into three sections (A, B, C), each section having a common drive force level and translatable assembly acceleration rate. In similar manner to FIG. 5, in FIG. 6 sectioning lines 50 and 52 define a first portion of the graph "A" illustrating force application and piston acceleration in chamber section A, sectioning lines 52 and 54 define a second portion of the graph "B" illustrating force application and piston acceleration in chamber section B, and sectioning lines 54 and 56 define a third portion of the graph "C" illustrating drive force application and piston acceleration in chamber section C. The solid line labeled "velocity" shows a piston velocity trace 58 during movement from bottom dead center to top dead center, while the broken line having triangular markers labeled "Force" shows drive force application trace 60 during movement from bottom dead center to top dead center position.

As is clear from FIG. 6, drive force requirements are highest when the drive assembly must accelerate/decelerate the translatable assembly 40. This is illustrated by the relatively extreme force trace values in portion "A" and portion "C" shown in the graph where the acceleration is changing. As a consequence, two things follow. First, the force required to accelerate the translatable assembly dictates the drive assembly force requirement, and limitations on available drive assembly technology thereby limit the size of electromagnetically actuated gas compressor construction. Second, for any electromagnetically actuated compressor governed by Equation 1, if the peak force load can be reduced, the size of the compressor can be increased without having to provide more powerful electromagnetic actuator.

Each time the compressor changes translation direction, the drive must (a) decelerate the moving translatable assembly to a stop, thereby overcoming the inertial force resident in the moving translatable assembly, and (b) accelerate the stopped translatable assembly in the opposite direction, thereby imparting an inertial force into the translatable assembly. As such, it would be advantageous to incorporate a mechanism into the compressor 10 that conserves the inertial force resident in a first movement for use in a second movement.

Figure 7:
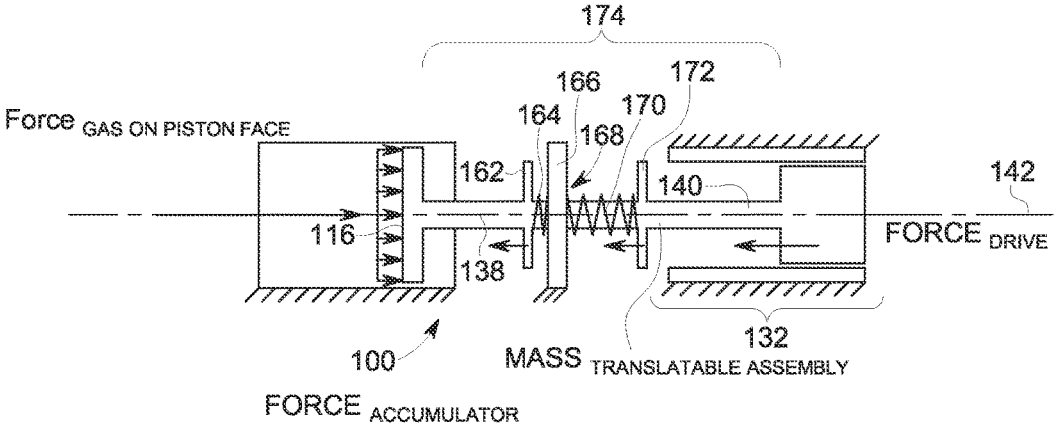
FIG. 7 shows an exemplary embodiment of a reciprocating compressor actuated with a linear motor and the forces influencing the translatable assembly while moving from bottom dead center to top dead center.
Figure 8:
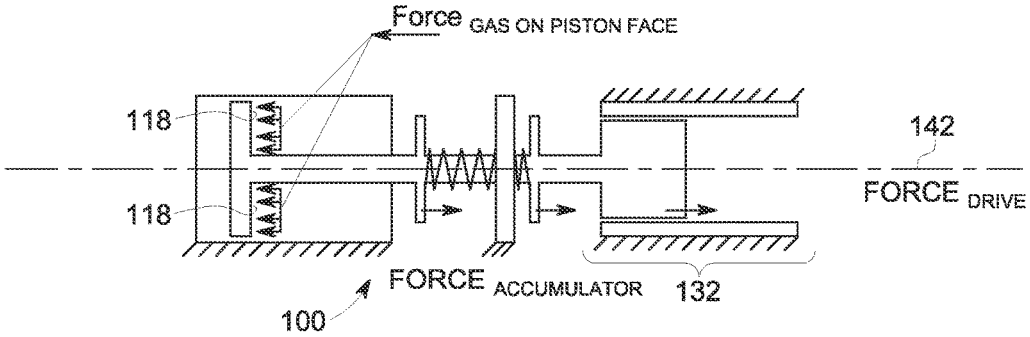
FIG. 8 shows the compressor of FIG. 7 and the forces influencing the translatable assembly while moving from top dead center to bottom dead center.

FIG. 7 and FIG. 8 show a non-limiting example of a compressor 100 configured to conserve the inertial force resident in the translatable assembly 140, thereby more particularly having reduced rod acceleration peak load with respect to the constant velocity loading.

FIG. 7 shows a compressor having an accumulator 174. Accumulator 174 comprises a connecting rod 138 defining a first movable flange 162 and a second movable flange 172. The accumulator 174 further comprises a post 166 having an aperture 168, the connecting rod 138 being slidably received within the post 166. The accumulator 174 further comprises a first resilient member 164 and a second resilient member 170. As shown in FIG. 7, the resilient member 164 is disposed between movable first flange 162 and fixed post 166. Similarly, resilient member 170 is disposed between movable second flange 172 and fixed post 166. The resilient members are configured such that, when the translatable assembly 140 is accelerating, the resilient members (164, 170) apply a force directed in substantially the same direction as that of drive 132 on the assembly 140, thereby reducing the force the drive assembly would otherwise need to apply in order to accelerate the assembly 140. The resilient members apply such force by returning to their respective relaxed states, as illustrated in the exemplary embodiment respectively as a compressed spring 164 and extended spring 170.

In like manner, resilient members are configured such that, when the translatable assembly 140 is decelerating, the resilient members (164,170) apply a force directed in substantially opposite same direction as that of the motion of translatable assembly 140, thereby decelerating the speed of assembly 140 and reducing the force the drive assembly 132 would otherwise need apply to the assembly 140 in order to decelerate the assembly 140. The resilient members apply such force by being deformed from their respective relaxed states (not shown). As such, the accumulator 174 has the technical effect of 'banking' the inertia resident in the moving translatable assembly 140 during a first assembly movement by decelerating the assembly, and returning that inertia to the assembly 140 by accelerating the assembly in a second assembly movement.

During an interval when the drive 132 accelerates the translatable assembly 140 along axis 142, the accumulator 174 more particularly applies force in concert with the drive 132, thereby assisting the drive 132 in both (a) overcoming the gas force applied on the piston first face 116, and (b) increasing the inertial force resident in the translatable assembly 140. During such an acceleration interval, the force produced by drive 132 must satisfies the equation:

$$F_{Drive}=(M_{Translatable\ Assembly})*\alpha+F_{Piston\ Face}-F_{Accumulator} \quad \text{(Equation 2)}$$

During an interval when the drive 132 decelerates the translatable assembly along axis 142, the accumulator 174 more particularly applies force in concert with the drive 132, thereby assisting the drive 132 in removing inertial force resident in the translatable assembly 140, thereby decelerating the assembly 140 in the head-end direction. During such a deceleration interval, the force produced by drive 132 satisfies the equation:

$$F_{Drive}=(M_{Translatable\ Assembly})*(-\alpha)+F_{Piston\ Face}+F_{Accumulator} \quad \text{(Equation 3)}$$

As shown in Equation 2 and Equation 3, the accumulator 174 has the technical effect of reducing the force that the drive 132 needs produce in order to accelerate the translatable assembly 140. Expanding the "$F_{Accumulator}$" term of Equation 2 and Equation 3 for an accumulator comprising a single spring, the force produced by the drive satisfies the equation:

$$F_{Drive}=(M_{Translatable\ Assembly})*(-\alpha)+F_{Piston\ Face}+(k*X) \quad \text{(Equation 4)}$$

Where k is a spring constant, and X is the displacement of the spring end connected to the translatable member from its equilibrium position. The springs (164,170) shown in FIG. 7 and FIG. 8 are illustrative only, and other force banking devices are within the scope of the present invention.

For example, in an embodiment a capacitor (not shown) having a first conductor (not shown) fixed and a second conductor (not shown) attached to the translatable assembly are separated by a dielectric (e.g. air); in this way, the capacitor has moving plates (to be precise one plate moves with respect to the other plate) and thus has a variable capacitance. According to a variant of this embodiment, the dielectric-occupied distance between the two conductive plates varies with translation of the translatable assembly. The first and second conductors may be charged once-for-all and left isolated during operation of the compressor, or may be charged differently and left isolated during distinct operating periods of the compressors, or may be permanently connected to a constant voltage generator during operation of the compressor, or may be permanently connected to a variable voltage generator during operation of the compressor (typically the voltage of the generator is varied slowly with respect to the oscillation period of the translatable assembly). Such an accumulator stores a changeable electric charge corresponding to movement of the translatable assembly, the capacitor thereby banking the inertial energy of assembly and being configured to supply the charge to power a subsequent translation of the translatable assembly. The use of one or more capacitor may be combined with the use of one or more springs that may have a constant or a variable spring constant.

More particularly, in embodiments having resilient members comprising a spring, the spring may be configured such that the drive actuates the translatable assembly so as to excite the translatable assembly at a resonance frequency of the spring. The spring, in turn, may be designed to make coincident the resonance period with a desired actuation time. Alternatively, the spring may be designed to make coincident a harmonic of the resonance period with the desired actuation time.

It is worth noting that the springs of the embodiments of the present invention may have a spring constant that is constant with respect to time and space which corresponds to the most common case for helical springs; alternatively, the spring constant may vary in time and/or in position, in particular along its length (i.e. it depends on the degree of compression of the spring).

Figure 9:
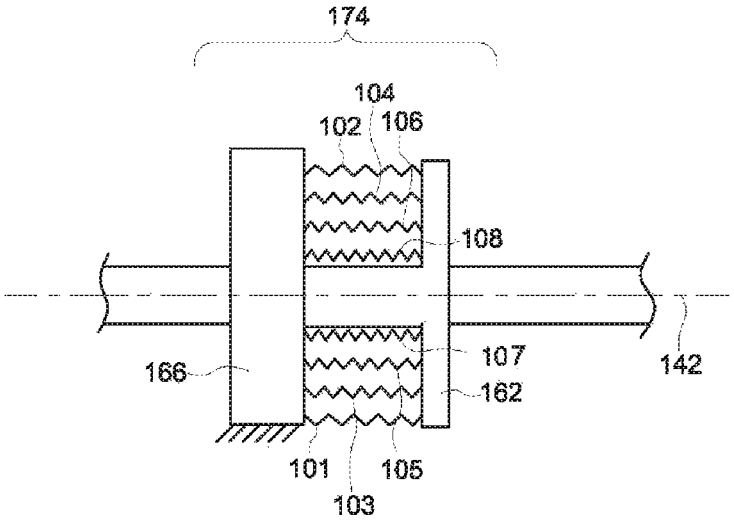
FIG. 9 shows an embodiment of a variable accumulator configured for use on a reciprocating compressor.

FIG. 9 shows an embodiment of a variable accumulator configured to vary compressor capacity by increasing stroke and maintaining actuation time, thereby allowing for magnet position to be optimized. In an illustrative manner, the illustrated accumulator 174 comprises a resilient member having a plurality of selectable parallel springs (101, 102, 103, 104, 105, 106, 107, 108). The number of springs used in a stroke can changed, thereby altering the spring constant k shown in Equation 4, thereby varying the stoke length and optimizing the magnet position.

More in general, it may be said that the accumulator of the embodiment of FIG. 9 comprises a spring assembly having a first end coupled to the translatable assembly and a second end fixed with respect to the translatable assembly. This spring assembly comprises a plurality of springs and the spring constant of this spring assembly is adjustable; in fact, the springs have different spring constant and are arranged in parallel so to be selectively effective. Alternatively, a spring assembly may comprise a plurality of springs having different lengths and arranged in parallel so to have different effective strokes (i.e. in a first displacement range of the translatable assembly a first set of springs are active on the translatable assembly, in a second displacement range a second set of springs are active, in a third displacement range a third set of springs are active, . . . ). The expression "arranged in parallel" is to be interpreted from the functional point of view; in fact, the axes of the springs may be parallel to each other (even coincident as a limit case) or inclined to each other.

Figure 10:
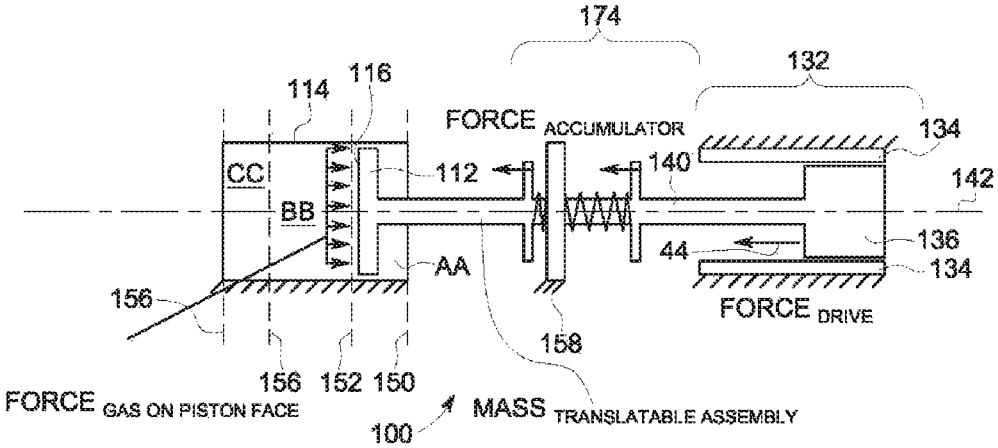
FIG. 10 shows the compressor of FIG. 7, wherein the compression chamber is illustratively divided into three regions, each region being associated with a different translatable assembly acceleration
Figure 11:
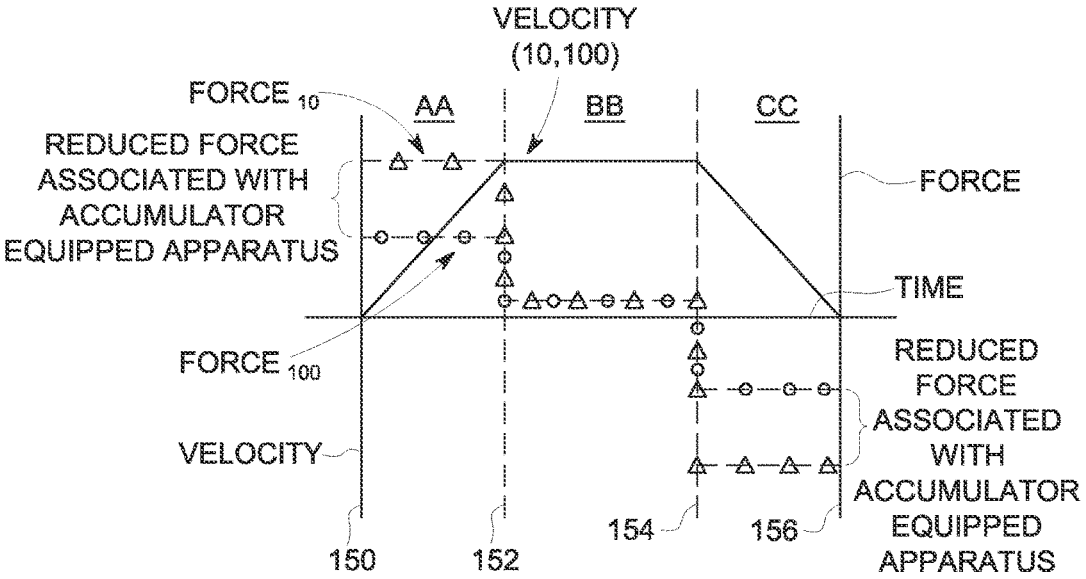
FIG. 11 shows a chart comparatively illustrating the relationship between velocity and force versus time when the compressor shown in FIGS. 7, 8 and 10 moves from top dead center to bottom dead center.

FIG. 10 and FIG. 11 show an advantageous technical effect of the compressor 100 over compressor 10 with respect to the peak force required to achieve a given velocity profile.

FIG. 10 shows compressor cylinder 114 divided into three sections (AA, BB, CC) by four cylinder sectioning lines (150,152,154,156). Sectioning lines 150 and 152 define chamber section AA, sectioning lines 152 and 154 define chamber section BB, and sectioning lines 154 and 156 define chamber section CC. As shown in FIG. 9 and with respect to Equation 2, when the piston 112 is at bottom dead center in cylinder section AA, drive 132 applies head-end oriented force sufficient to overcome both (a) the gas force applied on the piston first face 116, and (b) increase the inertial force resident in the translatable assembly 40, thereby accelerating the translatable assembly 140 in the head-end direction. When the piston 112 enters section BB, the force requirement drops, drive 132 supplying force sufficient only to overcome (a) the gas force applied on the piston first face 116. Inertia of the translatable assembly 140 is constant in cylinder section BB. When piston 112 enters section CC, drive 132 once again supplies an increased amount of force governed by Equation 3, sufficient to overcome both (a) the gas force applied on the piston first face 116, and (b) remove inertial force resident in the translatable assembly 140, thereby decelerating the translation of the assembly 140, causing the assembly to stop and leaving the piston in its top dead center position.

FIG. 11 graphically illustrates the velocity and force changes of the above discussion. FIG. 11 shows velocity and force graphed against time, time appearing on the x-axis, velocity appearing on the left y-axis, and force appearing on the right y-axis. Four graph sectioning lines (150,152,154, 156) corresponding to cylinder sectioning lines (150,152, 154,156) divide the graph into three sections (AA, BB, CC), each section having a common drive force level and translatable assembly acceleration rate. In similar manner to FIG. 10, sectioning lines 150 and 152 in FIG. 11 define a first portion of the graph "AA" illustrating force application and piston acceleration in chamber section AA, sectioning lines 152 and 154 define a second portion of the graph "BB" illustrating force application and piston acceleration in chamber section BB, and sectioning lines 154 and 156 define a third portion of the graph "CC" illustrating drive force application and piston acceleration in chamber section CC. A solid line labeled "velocity" shows a piston velocity trace during movement from bottom dead center to top dead center common to each compressor 10 and compressor 100. The broken line having triangular markers labeled "$Force_{10}$" shows drive force application by drive 32 of compressor 10 during movement from bottom dead center to top dead center position, while a broken line having circular markers labeled "$Force_{100}$" shows drive force application by drive 132 of compressor 100 during movement of piston 112 from bottom dead center to top dead center position. More particularly, the peak force requirement is lower for compressor 100 than compressor 10 in both region AA and CC, as illustrated in the chart where the "$Force_{10}$" trace diverges from the "$Force_{100}$" trace, the gap being labeled as "Reduced Force." The advantageous force requirement shown in FIG. 11 is illustrative and non-limiting; the acceleration/deceleration and constant velocity segments of piston travel may vary in different embodiments of the invention disclosed herein.

A further advantageous effect of compressor 100 is that existing linear motor technology can be adapted to construct machinery having commercially useful capacity.

For example, in a first non-limiting embodiment, compressor 100 comprises an electromagnetic drive assembly 132 having a synchronous linear motor. In this embodiment, the stator 134 comprises a plurality of conductive coils and the core 136 comprises a permanent magnet. The plurality of conductive coils is arranged coaxially and parallel with respect to the axis 142. Operatively, a coil within the plurality of coils can be individually energized, thereby generating a magnetic motive force pushes against core 136, thereby reciprocatably driving translatable assembly 140 along the axis 142.

Alternatively, in a second non-limiting embodiment, compressor 100 comprises an electromagnetic drive assembly 132 having an asynchronous linear induction motor. In this embodiment, the stator 134 comprises a plurality of conductive coils and the core 136 comprising a reaction plate constructed of a conductive material, such as copper or aluminum. The plurality of conductive coils is arranged substantially coaxially or parallel with respect to the axis 142. The plurality of coils connects to a three-phase AC power supply (not shown) and is configured such that, upon being energized, an electric current is induced in the reaction plate. The induced current produces a magnetic field that interacts with the coils, thereby producing a motive force that pushes the core 136, thereby reciprocatably driving translatable assembly 140 along the axis 142.

FIG. 12 through FIG. 17 show embodiments of compressors electromagnetically driven by a magnetic-geared drive.

Figure 12:
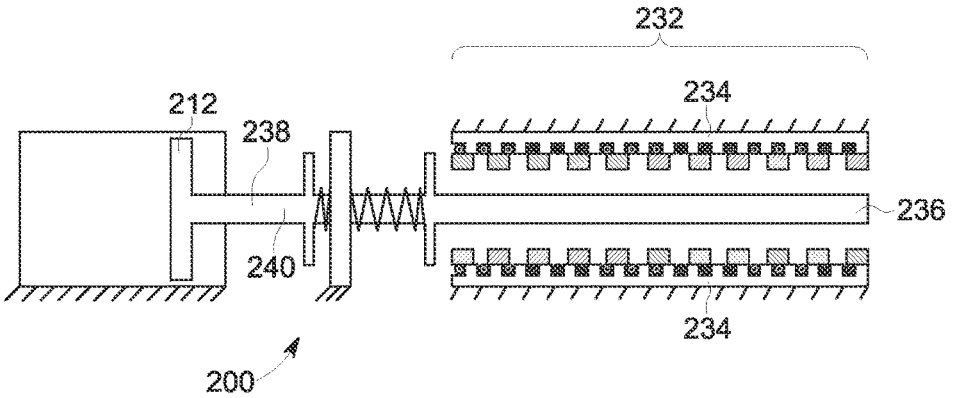
FIG. 12 shows an embodiment of a compressor driven by a magnetically geared linear motor.

FIG. 12 shows a magnetically-geared drive 232 in accordance with an embodiment of the invention. The magnetically-geared drive 232 is coupled to a connecting rod 238 and configured to reciprocatably translate piston 212 disposed within the cylinder (housing) 214 in response to signals originating from sensors (not shown) or a control system (not shown), or combinations thereof. The magnetically-geared drive 232 includes a core 236 disposed between a first stator and a second stator, the stators being collectively identified in FIG. 11 as stator 234. The core 236 is coupled to the connecting rod 238, and the core 236, connecting rod 238, and piston 212 comprise a translatable assembly 240.

Figure 13:
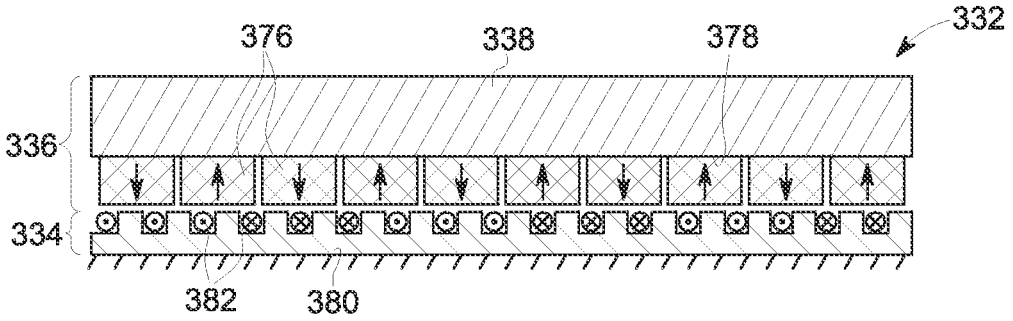
FIGS. 13, 14, 15, 16, and 17 show embodiments of a magnetically geared drives configured for use with a reciprocating compressor.

FIG. 13 shows an exemplary drive 332 suitable for the compressors disclosed herein. In the illustrated drive embodiment, the drive 332 includes a moveable core 336 and a stator 334. In the embodiment shown, the core 336 is outwardly disposed with respect to the stator 334. The core 336 includes a portion of the compressor connecting rod 338, and further comprises a plurality of permanent magnets 376 of alternating orientation (indicated by arrows) formed on a surface 378 of the connecting rod 338. The stator 334 includes a base 380 and a plurality of windings 382 coupled to the base 380. The number of permanent magnets 376 provided on the connecting rod 338 and the number of windings 382 provided on base 380 may vary depending upon the compressor application. More particularly, the torque density provided by the exemplary configuration allows for a significant reduction in compressor size, resulting in a cost and mass savings, thereby more particularly reducing peak force requirements by reducing the mass of translatable assembly 340 (not shown). As indicated above, an outer base/inner comprising a portion of the connecting rod 338 is one possible configuration for the compressor 300 (not shown) with integrated magnetic gearing. This is a non-limiting configuration. In another exemplary embodiment, the drive 332 includes an outer permanent magnet base and windings arrayed on a portion of the connecting rod. In such an embodiment, the plurality of permanent magnets 376 is provided on an inner surface of the base 380.

Figure 14:
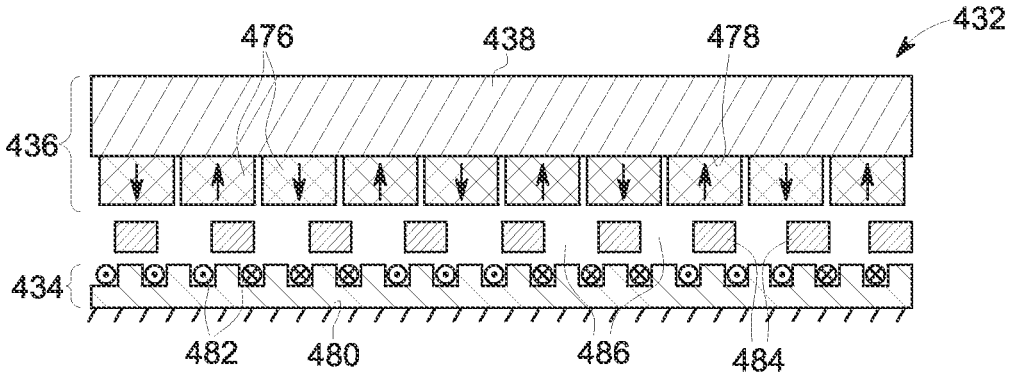

FIG. 14 shows a magnetically-geared drive 432 in accordance with another exemplary embodiment of the present invention. In the illustrated embodiment, the core 436 comprises a portion of the connecting rod 438 and a plurality of permanent magnets 476 of alternating orientation (shown by arrows) formed on an inner surface 478 of the portion of the connecting rod 438. The stator 434 includes a base 480 and a plurality of windings 482 coupled to the base 480. A plurality of stationary magnetic pole-pieces 484 is disposed within an air gap 486 formed between the plurality of core magnets 476 and the stator windings 482. Depending upon the compressor 400 (not shown) requirements, the pole-pieces 484 may be mounted to the base 480 (e.g., by stamping from the same lamination sheet as the stator core material) or may be separately mounted. In one embodiment, an air gap may be present between the base 480 and the pole-pieces 484. In another embodiment, a non-magnetic material may be inserted between the base 480 and the pole-pieces 484. The stationary pole-pieces 484 facilitate torque transmission between the magnetic field excited by the permanent magnet core 436 and the magnetic field excited by the stationary windings 482. The number of permanent magnets 476, stator windings 482 and the pole-pieces 484 may be varied depending upon the compressor application.

Figure 15:
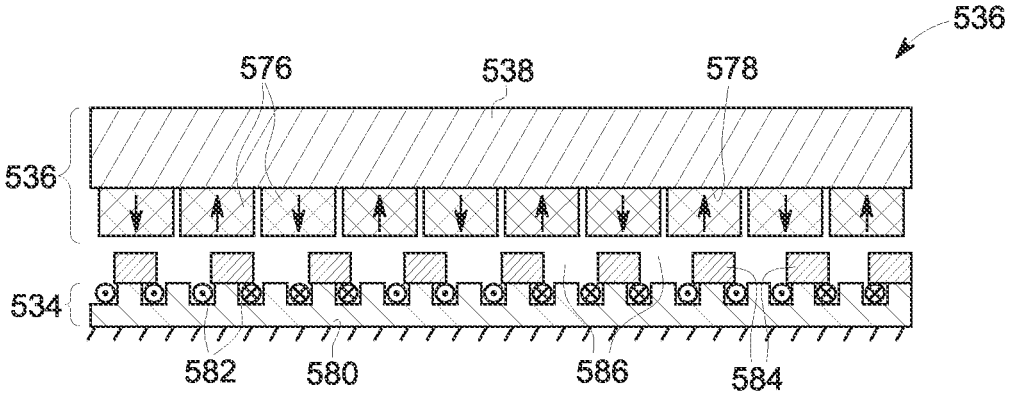

FIG. 15 shows a magnetically-geared drive 532 in accordance with another exemplary embodiment of the present invention. In the illustrated embodiment, the core 536 comprises a portion of the connecting rod 538 and a plurality of permanent magnets 576 of alternating orientation (shown by arrows) formed on an inner surface 578 of the connecting rod 538. The stator 534 includes a base 580 and a plurality of stator windings 582 coupled to the base 580. A plurality of stationary magnetic pole-pieces 584 is disposed within the air gap 586 formed between the core magnets 576 and the stator windings 582. In the illustrated embodiment, the pole-pieces 584 are integrated to the stator base 580. As discussed in the previous embodiment, the stationary pole-pieces 584 facilitate torque transmission between the magnetic field excited by the permanent magnet core 536 and the magnetic field excited by the stationary windings 582.

Figure 16:
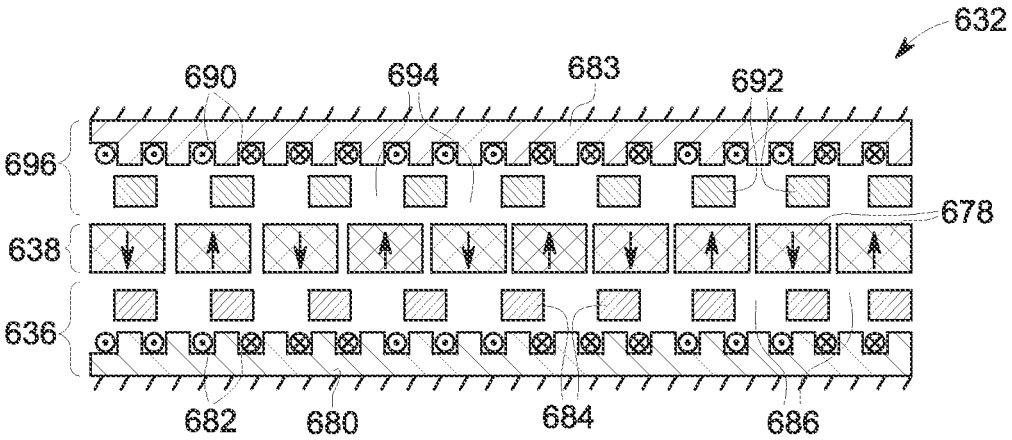

FIG. 16 shows a magnetically-geared drive 632 in accordance with another exemplary embodiment of the present invention. In the illustrated embodiment, the drive 632 includes a moveable core 638 disposed between a first stator 636 and a second stator 696. The core 638 comprises a plurality of permanent magnets 676 integrated with a portion of the connecting rod 638. Each stator includes a base (680,688) and a plurality of stator windings (682,690) coupled to their respective base. In the illustrated embodiment, a first set of stationary magnetic pole-pieces 684 is disposed within an air gap 686 formed between the core magnets 678 and the stator windings 682. A second set of stationary magnetic pole-pieces 692 is disposed with an air gap 694 formed between the core magnets 678 and the windings 690. Similar to the embodiment illustrated in FIG. 15, the first set of stationary magnetic pole-pieces 684 may be integrated to the stator first fixed base 680. The second set of stationary magnetic pole-pieces 692 may be integrated to the stator second fixed base 688.

Figure 17:
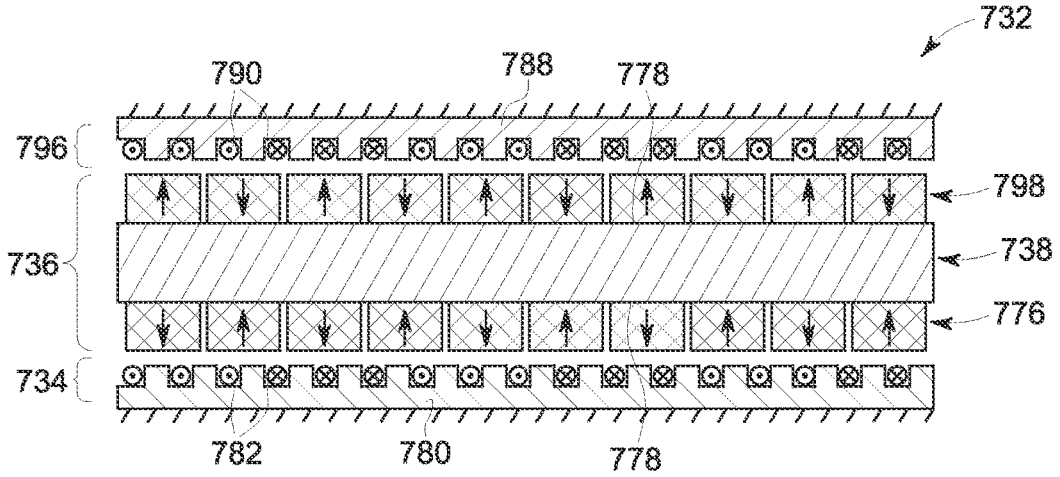

FIG. 17 shows a magnetically-geared drive 732 in accordance with another exemplary embodiment of the present invention. In the illustrated embodiment, the drive 732 includes a moveable core 736 disposed between a first stator 734 and a second stator 796. The core 736 comprises a portion of the connecting rod 738, a first set of permanent magnets 776 provided on a surface 778 of the connecting rod, and a second set of permanent magnets 798 provided on the surface 778 of the connecting rod. The first stator 734 includes a first fixed base 780 and a plurality of stator windings 782 coupled to the first fixed base 780. The second stator 796 includes a second fixed base 796 and a plurality of stator windings 790 coupled to the second fixed base 788. Similar to the embodiment illustrated in FIG. 15 and FIG. 16, stationary magnetic pole-pieces (not shown in FIG. 17) may be disposed between the rotor magnets and the stator windings or integrated into the stator cores.

In the various magnetically-geared drive embodiments depicted above, the cores of the compressors are implemented with permanent magnet cores. However, it is also contemplated that the integrated magnetic gearing may also be accomplished through the use of cores having wound field, squirrel cage, or switched reluctance poles. In other words, the core's magnetic field may be implemented through DC powered electromagnets, in lieu of permanent magnets. Furthermore, with regard to the stationary pole-pieces that serve as flux modulation devices, the shape of such pieces may be embodied by other insert shapes in addition to square inserts, such as oval or trapezoidal shapes for example. The configurations illustrated in the above embodiments are shown as including three-phase windings for purposes of example. It should also be understood that a different number of phases might be used as well.

More particularly, the embodiments shown in FIG. 12 through FIG. 17 allow for varying the speed and/or the volume swept by compressor piston by changing the timing and/or number of windings energized during a movement of the translatable assembly. This avoids the requirement to physically reconfigure the volume of the compression chamber (i.e. by turning down). These machines control capacity by mechanically displacing the head end of the compression cylinder with a manually operated crank, a feature which is more difficult to adapt to a controller programmed with a set of instructions recorded on a non-transitory machine readable media. In certain embodiments of the present invention, these instructions instruct the controller to (a) select a subset of windings to energize in a translation of the translatable assembly, (b) sequentially energize the windings so as to translate the translatable assembly at a target speed. In an embodiment, the translation speed is further selected such that compressor operates at a frequency substantially equal to the accumulator resilient member resonant frequency, thereby causing the resilient member to rapidly accumulate/discharge translatable member inertial energy. In another embodiment, the compressor operates at a harmonic of the resonant frequency of the resilient member, thereby accumulating a greater amount of inertial frequency, though lesser than would be case at the resonant frequency of the resilient member.

Figure 18:
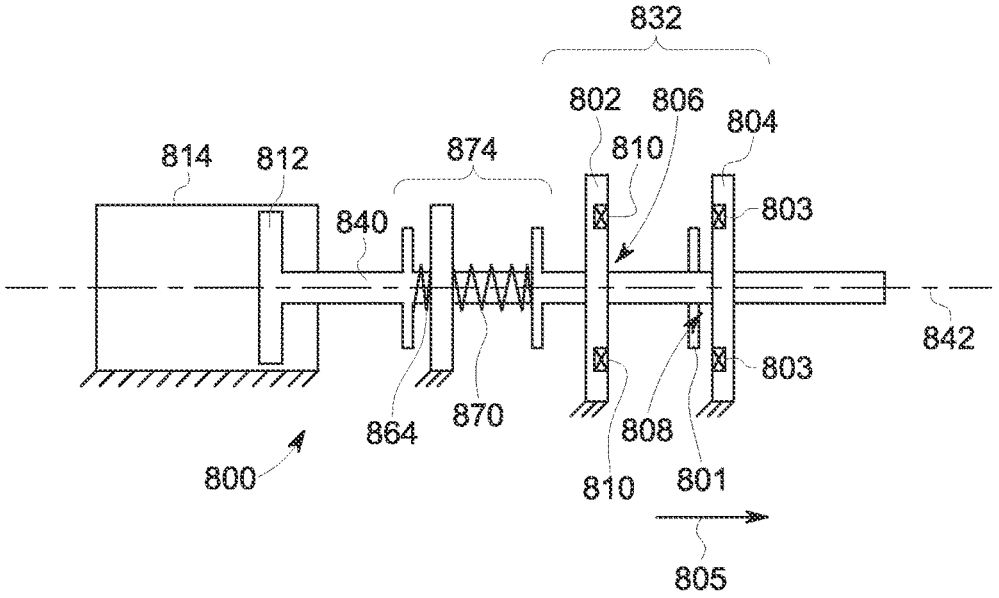
FIG. 18 shows an embodiment of a compressor driven by a solenoid drive.

FIG. 18 shows an embodiment of an electromagnetically driven compressor 800 having a solenoid drive 832.

FIG. 18 shows an exemplary compressor 800 having a bi-directional (BDE design) electromagnetic drive 832. The drive 832 includes two cores, a first core 802 having an aperture 806 and a second core 804 having an aperture 808. The cores may be made of iron or any other metal sheets with good magnetic properties to decrease size and weight of the drive. In one embodiment, the cores are made of iron-cobalt alloys. The exemplary drive 832 includes the first core 802 and the second core 804 having an "E" shape. In some other embodiments, the cores may have any other suitable shape including, but not limiting to "U" shape. The drive 832 further includes a plate 801 defined by the translatable assembly 840, the translatable assembly 140 being slidably received by the aperture 806 and aperture 808. In some embodiments, the drive may include four cores. The first core 802 includes a set of two coils 810 disposed within the first core 802. The second core 804 includes another set of two coils 803 disposed within the second core 804. In some embodiments, the cores may include more than two coils. The compressor 800 further includes an accumulator 874 having a first resilient member 864 and a second resilient member 870 configured as described above to provide forces to assist the movement of translatable assembly 840 along translation axis 842. The bi-directional drive 832 drivably engages the translatable assembly 840, thereby reciprocatably driving the piston 812 within the cylinder (housing) 814 as explained above.

As discussed in the preceding sections, the shape of the core of the drive described herein may be, for example, an "E" shape or a "U" shape. To generate a high electromagnetic force in the core in a very short span of time, the core of the solenoid as well as the plate are typically manufactured out of metal sheets to avoid eddy current effects as eddy current growing in the core may reduce the magnetic flux produced by the electromagnetic force. In order to facilitate reasonable ease of fabrication of the core out of metal sheets, a suitable design configuration should be used. The exemplary "E" shaped or "U" shaped cores described herein can be easily fabricated from metal sheets such as an iron sheet. Furthermore the "E" shaped core also provides a large area for the poles developed in the core once the coils are energized. Since the plunger is aligned through the center of the "E" shaped core, the magnetic force generated is distributed uniformly on both sides of the plunger (due to the uniform location of the coils with respect to the center of the "E" core and the movement of the plunger due the electromagnetic force may be balanced adequately.

Operationally, piston 812 assumes the bottom dead center position (shown in FIG. 18) when the current through the coils 803 in the second core 804 is turned on. Once the coils 803 are energized, the translatable assembly 104 is pulled towards the second core 804 (shown by arrow 805) thereby compressing the second resilient member 864. This is illustrated in FIG. 18. Alternatively, the piston 812 assumes the top dead center position (not shown) when the current through the coils 803 is turned off, and the current through the coils 810 in the first core 802 is turned on. As a result, the translatable assembly 840 is pushed towards the first core 802 guided by the first resilient member 864, and piston 812 translates to the top dead center position. More particularly, the bi-directional design of the drive may cover longer strokes compared to the unidirectional designs and provides a higher force during the initial stage of the stroke than conventional linear motors. This higher force is due to the fact that in both the end positions (either bottom dead center or top dead center) of the stroke, the preloaded compressed resilient members 864 or 870 provides a high initial force, which force pushes the translatable assembly 804 and the plate 802 towards the opposite core. Hence the spring force more particularly gets added to the weak magnetic forces, present at the beginning of the stroke due to the large air gap between plate 802 and iron cores 802 and 804 and enhances the initial force.

In a solenoid drive embodiment (not shown), one or both the cores may be independently translatable along the translation axis. Such adjustability more particularly allows for adjustment piston travel distance between bottom dead center position and top dead center position, thereby adjusting the capacity of the compressor. In another embodiment, frequency and translation speed may be adjusted by compensating for the accumulator configuration as described above.

Figure 19:
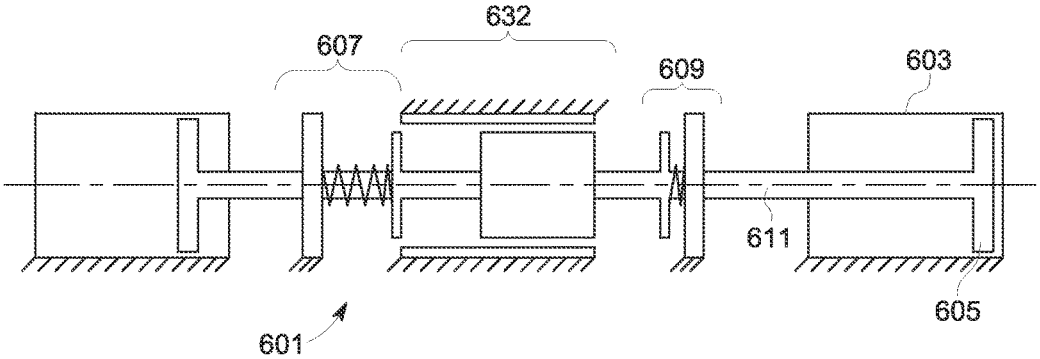
FIG. 19 shows an embodiment of a compressor having two compression assemblies and a linear motor drive.
Figure 20:
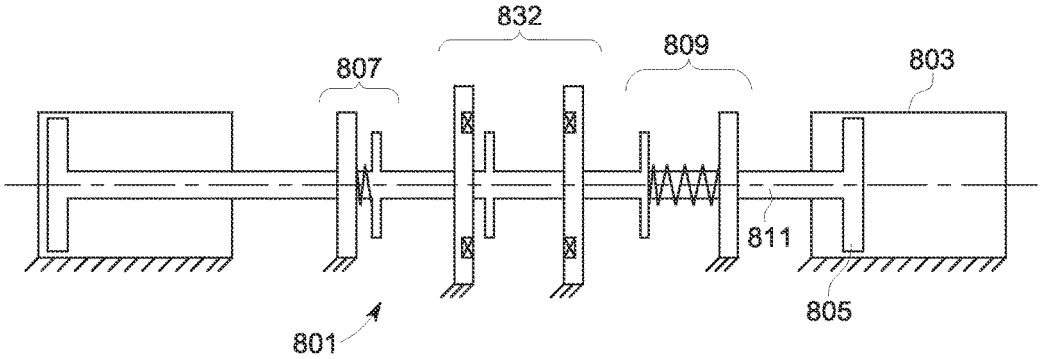
FIG. 20 shows an embodiment of a compressor having two compression assemblies and a solenoid actuator.

While only certain features of the invention have been illustrated and described herein, many modifications and changes will occur to those skilled in the art. For example, FIG. 19 shows an embodiment of the invention where a compressor 601 further comprises a second cylinder (housing) 603, a translatable assembly 611 having a second piston 605, and first accumulator 607 and second accumulator on either side of the drive 632. The device operates as described above, and more particularly doubles compression cylinder space, incorporating the advantages described above. Similarly, FIG. 20 shows an embodiment of the invention where a compressor 801 further comprises a second cylinder (housing) 803, a translatable assembly 811 having a second piston 805, and first accumulator 807 and second accumulator on either side of the drive 832. The device operates as described above, and more particularly doubles compression cylinder space, incorporating the advantages described above. It is, therefore, to be understood that the appended claims are intended to cover all such modifications and changes as fall within the true spirit of the invention.

In an embodiment of the invention, a method of operating a reciprocating compressor comprises accelerating a translatable assembly in a first direction. Acceleration comprises, from a substantially motionless state, applying force to the translatable assembly such that it achieves some desired velocity. Once the target velocity is reached, force is applied to substantially overcome the force applied at the piston face of the translatable assembly by the gas occupying the compression chamber of the reciprocating compressor. Accelerating the translatable assembly imparts inertia to the translatable assembly, and increases the kinetic energy resident in the translatable assembly.

The method further comprises decelerating the translatable assembly while it travels in the first direction. Decelerating the translatable assembly is accomplished by shifting a portion of the inertia resident in the translatable assembly into the accumulator, such as by deforming the above-discussed resilient member. Decelerating the translatable assembly reduces the inertia resident in the translatable assembly, and reduces the kinetic energy associated with the assembly during its movement in the first direction.

The method additionally comprises accelerating the translatable assembly in a second direction using energy stored in the accumulator. In one embodiment, a resilient member, deformed during the first movement of the translatable assembly, relaxes and returns to its original state, thereby applying force to the translatable assembly and accelerating the assembly during its second movement.

It will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A reciprocating compressor, comprising:

a piston reciprocatably disposed in a cylinder;

a translatable assembly connected to the piston;

an electromagnetic drive configured to reciprocatably drive the translatable assembly; and an accumulator coupled to the translatable assembly, wherein the accumulator comprises:

a connecting rod defining a first movable flange and a second movable flange;

a fixed post disposed between the first movable flange and the second movable flange and configured to slidably receive the connecting rod;

a first resilient member positioned between the first movable flange and the fixed post, wherein the first resilient member is co-axial with the connecting rod; and a second resilient member positioned between the second movable flange and the fixed post, wherein the second resilient member is co-axial with the connecting rod, wherein, when the translatable assembly is moving in a first direction during an acceleration phase, the first and the second resilient members apply a force in a same direction to accelerate the translatable assembly in the first direction, and wherein, when the translatable assembly is moving in a second direction during a deceleration phase, the first and the second resilient members apply a force in an opposite direction to decelerate the translatable assembly in the second direction.

2. The reciprocating compressor of claim 1, the electromagnetic drive comprising:

a stator fixed with respect to the translatable assembly, the stator having a plurality of coils; and a core connected to the translatable assembly, wherein the compressor is configured to vary a translatable assembly translation distance by selecting a coil to be electrified from the plurality of coils.

3. The reciprocating compressor of claim 1, wherein the piston defines a first piston face and a second piston face, wherein the cylinder and the first piston face cooperatively define a first compression chamber, the first compression chamber pneumatically communicative with a gas supply and a gas transmission network; and wherein the cylinder and the second piston face cooperatively define a second compression chamber, the second compression chamber pneumatically communicative with the gas supply and the gas transmission network.

4. The reciprocating compressor of claim 1, wherein the first and the second resilient members each comprises a spring, and wherein a spring constant of the spring is adjustable.

5. The reciprocating compressor of claim 4, wherein at least one of the springs has a spring constant that is variable along its length.

6. The reciprocating compressor of claim 1, wherein the electromagnetic drive comprises a stator fixed with respect to the translatable assembly and a core connected to the translatable assembly.

7. The reciprocating compressor of claim 6, the electromagnetic drive further comprising a plurality of magnetic pole pieces disposed between the stator and the core.

8. The reciprocating compressor of claim 1, the electromagnetic drive comprising: a first core with at least one coil disposed therein, wherein the first core is fixed with respect to the translatable assembly; a second core having at least one coil disposed therein, wherein the second core is fixed with respect to the translatable assembly; and a plate defined by the translatable assembly; wherein the plate is drawn to the first core or the second core upon electrification of the at least one coil disposed therein.

9. The reciprocating compressor of claim 8, wherein an axial distance between the first core and the second core is adjustable.

10. A method of operating a reciprocating compressor comprising a translatable assembly, an accumulator coupled to the translatable assembly, and an electromagnetic drive coupled to the translatable assembly, the method comprising:

applying a force, using the accumulator, in a same direction to accelerate the translatable assembly in the same direction when the translatable assembly is moving in a first direction during an acceleration phase; and applying a force, using the accumulator, in an opposite direction to decelerate the translatable assembly in the opposite direction when the translatable assembly is moving in a second direction during a deceleration phase, wherein the accumulator comprises:

a connecting rod defining a first movable flange and a second movable flange;

a fixed post disposed between the first movable flange and the second movable flange and configured to slidably receive the connecting rod;

a first resilient member positioned between the first movable flange and the fixed post, wherein the first resilient member is co-axial with the connecting rod; and a second resilient member positioned between the second movable flange and the fixed post, wherein the second resilient member is co-axial with the connecting rod.

11. The method of claim 10, further comprising selecting a first movement distance; and selecting a second movement distance different than that of the first movement distance.

12. The method of claim 10, wherein the accumulator is a variable accumulator, the method further comprising configuring the accumulator to store a desired amount of energy during the movement of the translatable assembly.

13. A reciprocating compressor, comprising:

a piston reciprocatably disposed in a cylinder;

a translatable assembly connected to the piston;

an electromagnetic drive configured to reciprocatably drive the translatable assembly; and an accumulator coupled to the translatable assembly, wherein the accumulator comprises:

a connecting rod defining a first movable flange and a second movable flange;

a fixed post disposed between the first movable flange and the second movable flange and configured to slidably receive the connecting rod;

a first resilient member positioned between the first movable flange and the fixed post; and a second resilient member positioned between the second movable flange and the fixed post, wherein, when the translatable assembly is moving in a first direction during an acceleration phase, the first resilient member and the second resilient member apply a force in a same direction to accelerate the translatable assembly in the first direction, and wherein, when the translatable assembly is moving in a second direction during a deceleration phase, the first resilient member and the second resilient member apply a force in an opposite direction to decelerate the translatable assembly in the second direction.

14. The reciprocating compressor of claim 13, wherein the first resilient member and the second resilient member each comprises springs having different lengths to have different effective strokes.

15. The reciprocating compressor of claim 13, wherein the first resilient member and the second resilient member each comprises springs having different spring constants to be selectively effective.

16. The reciprocating compressor of claim 13, wherein the electromagnetic drive comprises a stator fixed with respect to the translatable assembly and a core connected to the translatable assembly.

* * * * *